US005265731A

United States Patent [19]

Van de Ven

[11] Patent Number: 5,265,731

[45] Date of Patent: Nov. 30, 1993

[54] JOB SEPARATOR

[75] Inventor: John Van de Ven, Grand Island, N.Y.

[73] Assignee: Moore Business Forms, Inc., Grand Island, N.Y.

[21] Appl. No.: 788,797

[22] Filed: Nov. 8, 1991

[51] Int. Cl.[5] ..... B07C 5/00

[52] U.S. Cl. ..... 209/552; 209/583; 414/794.9; 414/790.7; 271/236; 271/245; 271/246; 271/198; 271/212; 271/213

[58] Field of Search ..... 271/236, 245, 246, 275, 271/198, 212, 213, 220; 414/794.9, 795, 790.7; 209/583, 569, 552

[56] References Cited

U.S. PATENT DOCUMENTS

| | | | |
|---|---|---|---|
| 3,327,597 | 6/1967 | Donahue et al. | 93/93 |
| 3,373,666 | 3/1968 | Crampton | 93/93 |
| 3,543,651 | 12/1970 | Donahue | 93/93 |
| 3,638,538 | 2/1971 | Sullivan | 93/93 |
| 3,871,539 | 3/1975 | Nikkel | 271/212 |
| 4,029,216 | 6/1977 | Adams et al. | 214/1 BB |
| 4,077,181 | 3/1978 | Asher et al. | 53/78 |
| 4,297,066 | 10/1981 | Ramcke et al. | 414/43 |
| 4,426,073 | 1/1984 | Mizuma | 271/251 |
| 4,522,617 | 6/1985 | Mowry | 414/794.9 |
| 4,541,626 | 9/1985 | Miller | 271/236 |
| 4,640,506 | 2/1987 | Luperti et al. | 414/790.7 |
| 4,799,663 | 1/1989 | Golicz | 271/199 |
| 4,971,304 | 11/1990 | Lofthus | 271/236 |
| 5,123,639 | 6/1992 | Edwards | 271/212 |
| 5,147,092 | 9/1992 | Driscoll et al. | 271/245 |

FOREIGN PATENT DOCUMENTS

| | | |
|---|---|---|
| 3735974 | 5/1988 | Fed. Rep. of Germany . |
| 2087732 | 12/1971 | France . |
| 1058041 | 2/1967 | United Kingdom . |

*Primary Examiner*—H. Grant Skaggs
*Attorney, Agent, or Firm*—Nixon & Vanderhye

[57] ABSTRACT

Business form components are stacked to separate them into different jobs, and after stacking are synchronously conveyed together to a pressure sealer, or similar device, for sealing the components together into a business form or are conveyed to subsequent operations such as secondary stacking into larger stacks. Each component moves from an aligner/feeder to a stacker, moving up an incline of a continuously running conveyor belt so that each successive component passes underneath any previous components in a stack. When a movable stop against which the components are held rotates out of the way, a top roller near the trailing ends of the components pinches them against a bottom roller so that the components move together away from the stacker in register with each other. A sensor senses each component as it passes to the stacker, and when the desired number for a stack have moved past the sensor, a controller controls the operation of the stop and top roller to allow the continuously running conveyor belt to move the stacked components out of the stacker.

18 Claims, 4 Drawing Sheets

JOB SEPARATOR

BACKGROUND AND SUMMARY OF THE INVENTION

Particularly in the production of business forms, but in other areas as well, it is desirable to be able to intelligently separate, stack, and deliver individual components. For example, it is desirable to intelligently separate, stack and deliver cut or burst business form from a variety of sources such as inserters, printers, mailing lines, and the like. The forms could be individual cut sheets, bound or fastened packets of sheets, envelopes with or without sheets inside, and the like, and may be sorted in repeatable or variable quantities or as data changes within the forms, such as changes in postal codes. All of these individual elements that may make up the final products are referred to in this specification and claims as "business form components".

According to the method and apparatus of the invention, it is possible to intelligently separate, stack, and deliver business form components in a simple and cost-effective manner, allowing considerable variability in parameters. According to the invention it is possible to sort business form components and stack them up to about four inches high at speeds of the host machine of up to about 300 pieces per minute. Form component length can vary from four inches to 14 inches, and width from 3.5 inches to 12 inches. The number of form components for a particular stack are automatically counted, regardless of the speed, under 300 pieces per minute, or manner in which they are supplied from the host machine, and the number of form components to be provided in any one stack may be varied as the machine is running. Stack separation is determined by scanning data on the form components, a signal from the host machine or fixed count to determine the number of components to be provided in a particular stack. The invention is also, but not exclusively, utilizable for forming business forms from business form components, having pressure sensitive adhesive thereon which pass through a pressure sealer after stacking, to be permanently affixed together.

According to one aspect of the present invention, apparatus is provided for separating business form components (or any like structures) into different jobs. The apparatus comprises: Feed means for automatically feeding business form components in a first direction. Collector means comprising conveying means having a top, conveying, surface continuously running in the first direction, and a movable stop means cooperating with the conveying means top surface, movable between a first position preventing conveyance of business form components past the stop means by the conveying means, and a second position, allowing conveyance of business form components therepast. Sensor means for sensing passage of form components from the feed means to the collector means in the first direction. Control means for controlling the position of the stop means in response to input from the sensor means. And, wherein the collector means comprises means for feeding each successive form component from the feed means into engagement with the conveying means top surface regardless of whether or not other form components are already on the conveying means top surface and engaging the stop means.

The feed means may comprise means for aligning business form components so that one side edge thereof, parallel to the first direction, is in a predetermined position when delivered to the collector means. The aligning means is preferably that described in co-pending application Ser. No. 07/604,858 filed Oct. 26, 1990, the disclosure of which is hereby incorporated by reference herein. An adjustable edge guide may be disposed above the conveying means and movable into alignment with the aligning means, or opposite thereto.

The collector means conveying means preferably comprises a plurality of conveyor belts or tapes with the stop means comprising a plurality of stop elements mounted on a shaft, and extending between the belts in the first position. The conveying means also include a first portion closest to the feed means, and a second portion cooperating with the stop means; and wherein the first portion is slanted upwardly from the feed means to the second portion so that a form component stopped by the stop means and in association with the second portion slightly overlaps the first portion, so that a form component passing on the first portion will pass under the business form component already resting on the second portion. Also the apparatus may comprise synchronizing means for selectively engaging business form components when on the conveying means top surface and abutting the stop means to ensure that the components are moved together, synchronously, past the stop means once the stop means are moved to the second position.

According to another aspect of the present invention apparatus is provided comprising: Feed means for automatically feeding business form components in a first direction. Collector means comprising conveying means having a top, conveying, surface for conveying form components in the first direction, and a movable stop means cooperating with the conveying means top surface, movable between a first position preventing conveyance of business form components past the stop means by the conveying means, and a second position, allowing conveyance of business form components therepast. Sensor means for sensing passage of form components from the feed means to the collector means in the first direction. Synchronizing means for selectively engaging business form components when on the conveying means top surface and abutting the stop means to ensure that the components are moved together, synchronously, by the conveying means past the stop means once the stop means is moved to the second position. And, control means for controlling the position of the stop means and the synchronizing means in response to input from the sensor means so that the synchronizing means are operated to engage the business form components in coincidence with movement of the stop means to the second position.

The synchronizing means preferably comprises a first roller mounted above the conveying means and for moving the first roller into contact with the business form components to ensure that they are conveyed together when the stop means is moved to the second position. The synchronizing means further comprises a second, stationary, roller mounted below the first roller and having a peripheral portion at approximately the same vertical position as the top surface of the conveying means, below the first roller. The second roller cooperates with the first roller when the first roller is moved into engagement with business form components on the conveying means top surface, so that business form components are pinched between the rollers. The first and second rollers preferably are disposed at approximately the interface between the first (slanted) and second portions of the conveyor, just past that interface above the second portion.

According to another aspect of the present invention, a method of separating business form components into separate jobs, for affixing together into a business form, is provided. The method comprises the steps of: (a) Continuously feeding business form components in a first direction one at a time to a stacking position. (b) At the stacking position, collecting in a stack the desired number of business form components to construct a business form. (c) Once a stack of a predetermined number of business form components has been collected, immediately and synchronously conveying all of the components in the stack in the first direction toward a forming position. And, (d) at the forming position, forming the business form components in the stack into a business form. Typically, though not necessarily, the business form components have patterns of pressure sensitive adhesive (such as Toppan Moore pressure sensitive adhesive TM-124, a styrene-natural rubber copolymer), and they are sealed by conventional pressure sealing equipment, such as that marketed by Moore Business Forms, Inc. of Lake Forest, Ill. under the trademark "SPEEDISEALER ®"; typical apparatus is that shown in co-pending application Ser. No. 07/605,797 filed Oct. 31, 1990. Using such equipment, step (d) is practiced by applying a compressive force to only those portions of the business form components actually having pressure sensitive adhesive associated therewith to seal the form components together with the pressure sensitive adhesive.

Steps (a) and (b) may be practiced so that each successive business form component fed to the stacking position is fed underneath any business form components already at the stacking position. Also the method may be practiced utilizing a stop element on a rotatable shaft which stops movement of the forms when the shaft is substantially vertical. Step (c) is then practiced by: Rotating the shaft approximately 270 degrees in a first direction from the vertical, stop, position of the stop element, to allow passage of forms therepast. Stopping rotation of the shaft at the approximately 270 degree position. And, after the form components in a stack have completely passed the stop element, rotating the shaft approximately 90 degrees in the first direction so that the stop element is back in its vertical, stop, position.

It is the primary object of the present invention to provide a simple and effective method and apparatus for intelligently separating, stacking, and delivering business form components or the like. This and other objects of the invention will become clear from an inspection of the detailed description of the invention, and from the appended claims.

DETAILED DESCRIPTION OF THE DRAWINGS

Figure 1:
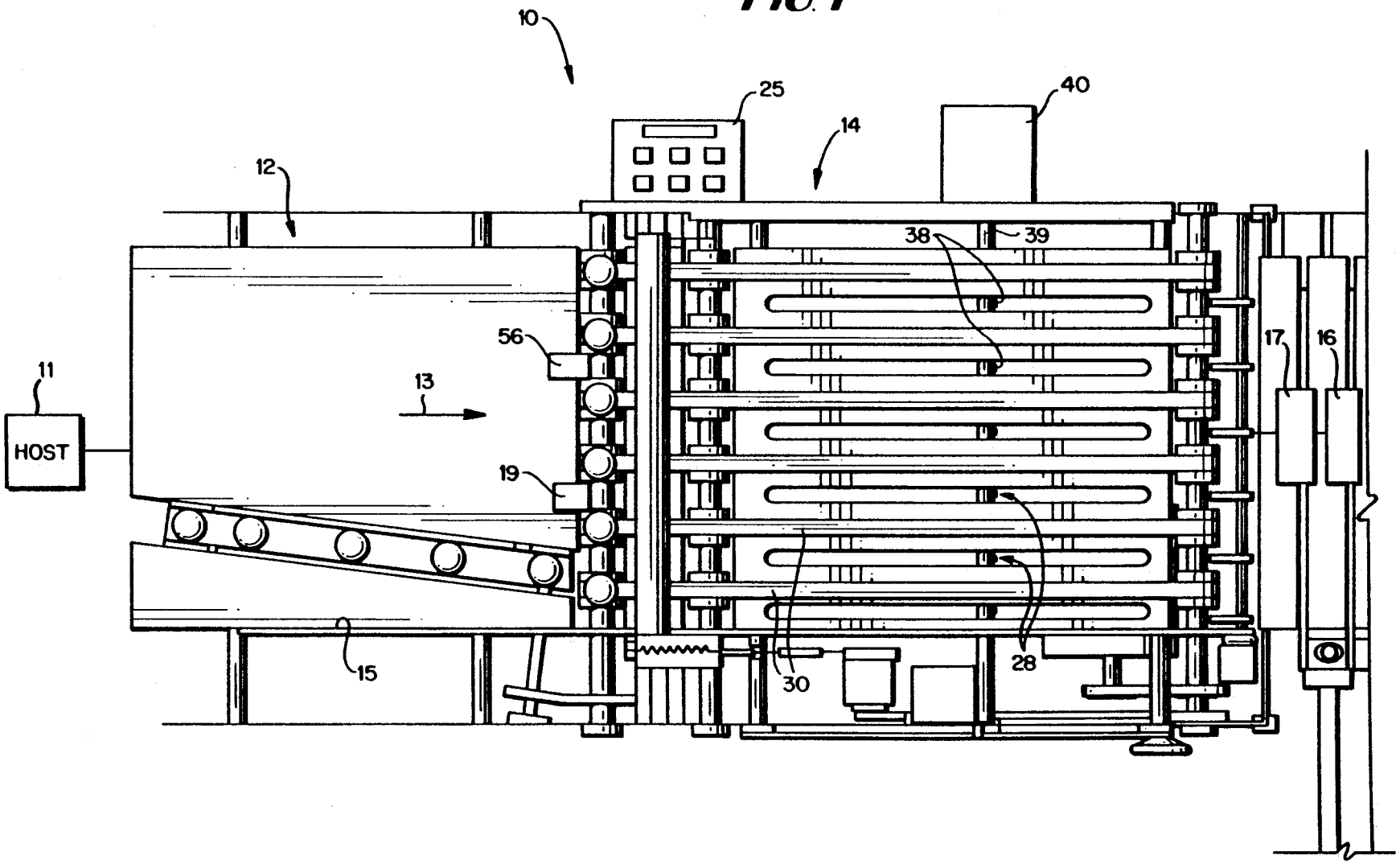
FIG. 1 is a top view, with some components removed for clarity of illustration, of an exemplary job separator and stacker according to the present invention.
Figure 2:
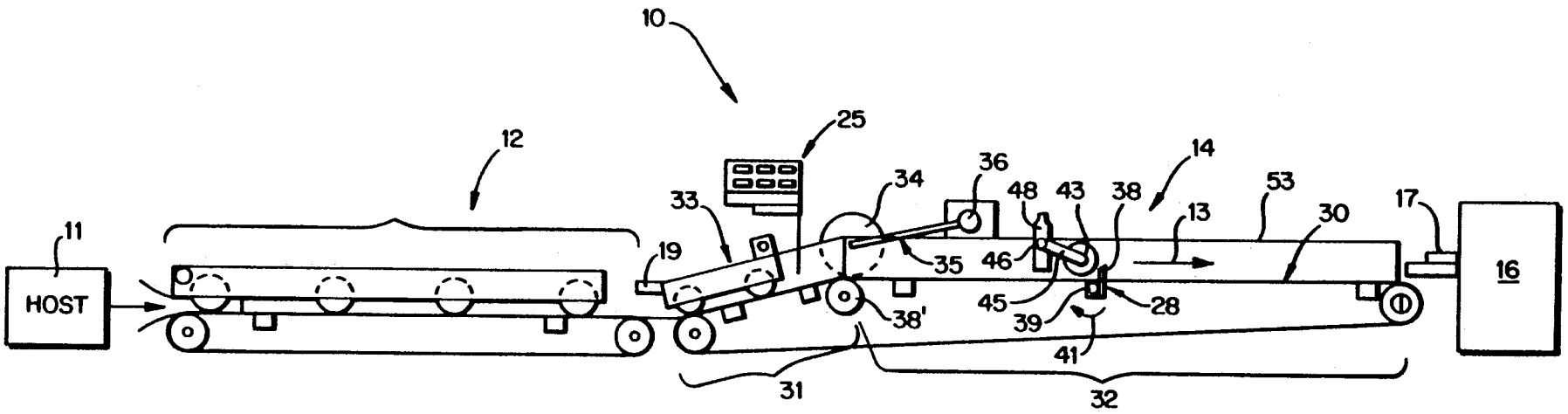
FIG. 2 is a side view, with some components removed for clarity of illustration, of the job separator and stacker of FIG. 1.
Figure 3:
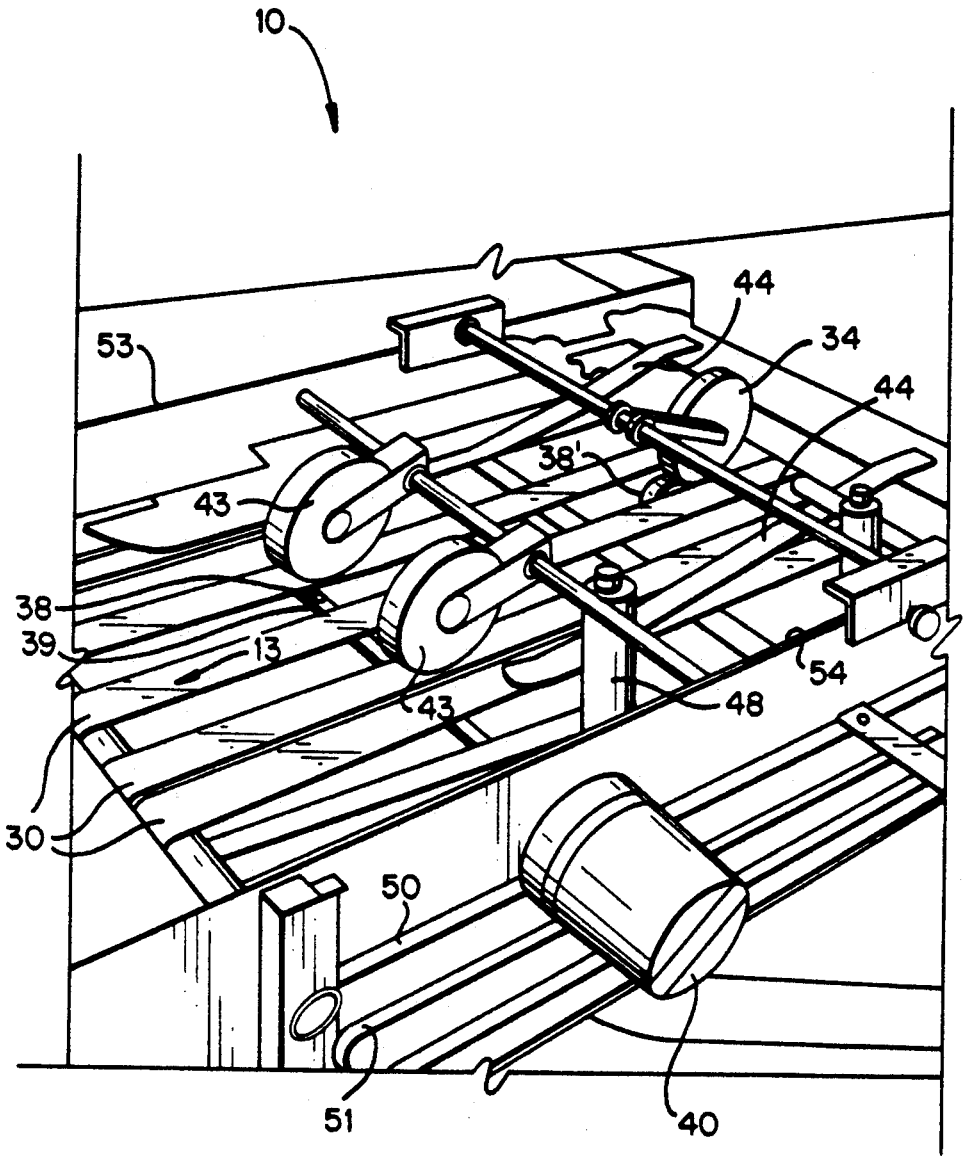
FIG. 3 is a detail top perspective view of the job separator and stacker of FIG. 1.

Apparatus for separating business form components into different jobs is illustrated generally by reference numeral 10 in FIGS. 1 through 3. Typically a host machine 11, such as a burster, inserter, printer, mailing line, or the like, feeds forms to the forms aligner 12, which itself comprises feed means for automatically feeding business form components in a first direction 13 toward a collector means 14. The forms aligner 12 comprises means for aligning business form components so that one side edge thereof, parallel to the first direction 13, is in a predetermined position when delivered to the collector means 14, e.g. the business form component edge is against the edge guide 15 of the forms aligner 12. The forms aligner 12 per se is shown in U.S. Pat. No. 5,199,597, the disclosure of which is incorporated by reference herein. Downstream in the first direction 13 of the collector means 14 may be any suitable other apparatus, such as a separator/stacker, pressure sealer of a Moore SPEEDISEALER ® pressure sealing system, 16, diverter 17, and/or other conventional equipment.

Figure 4:
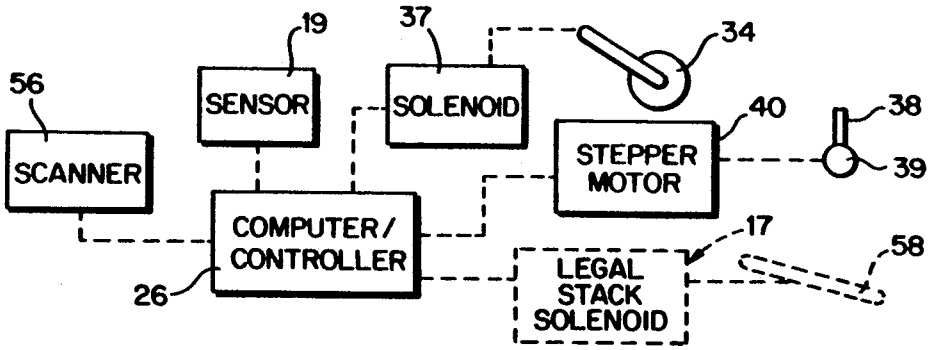
FIG. 4 is a control schematic for the apparatus of FIGS. 1-3.
Figure 6:
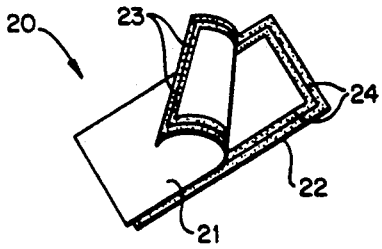
FIG. 6 is a top perspective view of an exemplary pair of business form components used to construct a business form in accordance with the method of the present invention.

The apparatus 10 preferably includes a sensor means, shown schematically at 19 in FIGS. 1 and 4, for sensing passage of a form component from the feed means/aligner 12 to the collector means 14 in the first direction 13. The sensor 19 may comprise any conventional suitable sensor, such as a reflective sensor that is capable of detecting the trailing edge of the business form components moving therepast. FIG. 6 illustrates two exemplary business form components 20 that may be utilized according to the invention, including a first component 21 and a second component 22, in this case the components 21, 22 being sheets of printed paper, and having patterns (strips) of pressure sensitive adhesive 23, 24, (such as Toppan Moore TM-124) disposed at various portions therealong.

The apparatus 10 also preferably comprises control means, which may comprise the control panel 25 (FIGS. 1 and 2) which has a computer chip (controller), shown schematically at 26 in FIG. 4, therein. The control means 25, 26 controls the position of a stop means 28 associated with the collector means 14.

The collector means 14 preferably comprises conveyor means, such as a plurality of spaced (in a horizontal direction perpendicular to the first direction 13) conveyor belts or tapes 30, and the stop means 28. The conveyor means 30 is preferably divided into first and second portions, shown generally by reference numerals 31 and 32 in FIG. 2. The first portion 31 is disposed at an upward slant of a significant amount (e.g. 10 to 40°), relative to the generally flat second portion 32, with which the stop means 28 cooperates. Conventional ball bearing hold down means 33 cooperates with the upwardly slanted section 31 to hold business form components 20 in contact with the conveyor belts 30 of the first portion 31.

At approximately the interface between the first and second portions 31, 32 are provided synchronizing means for selectively engaging business form components 20 when on the conveying means 30 top surface (see FIG. 1) and abutting the stop means 28, to ensure that the components 20 are moved together, synchronously, by the conveying means 30 past the stop means 28 once the stop means 28 is moved to a second position wherein it does not abut the leading edges of the components 20 (with the conveyor means 30 continuously running).

The synchronizing means preferably comprises a first, top roller 34 which may or may not be driven and is mounted by an arm 35 to a solenoid controlled shaft 36, the solenoid being shown schematically at 37 in FIG. 4. The roller 34 is normally above the business form components, but upon operation of the solenoid 37, the shaft 36 is rotated so that the roller 34 moves downwardly, to a position above the stationary, hard roller 38' (see FIG. 2), at which point business form components 20 are pinched between the rollers 34, 38' so that when the stop means 28 is moved out of the way all of the business form components in a stack held by the stop 28 move uniformly and synchronously together (in registry with each other) in the first direction 13.

While the stop means 28 may take a wide variety of forms, the preferred form is that illustrated in FIGS. 1 through 3. A plurality of stop elements, or stop fingers, 38 are mounted on a common shaft 39 which is driven by a stepper motor 40. The stop elements 38 extend upwardly between spaced conveyor tapes 30 (see FIG. 1) and when they extend substantially vertically upward (as in FIGS. 2 and 3), they engage the leading edges of the business form components 20 which are on the top surface of the continuously running conveyor tapes 30, and prevent further movement thereof in the direction 13. However once the desired number of business form components 20 have been fed to the stack on the collector means 14, and the roller 34 has been brought down into engagement with the business form components, the stepper motor 40 is controlled by the computer 26 to rotate in direction 41 (see FIG. 2) approximately 270°, so that fingers 38 no longer extend above the top surface of the conveyor tapes 30, and therefore allow the conveyor tapes 30 to convey the business form components 20 in the direction 13 to the apparatus 16, 17. Once the trailing edges of the business form components 20 have passed the stop means 28, the stepper motor 40 is then controlled to rotate the shaft 39 in the direction 41 about another 90° so that the stop fingers 38 return to their stopping position (FIGS. 2 and 3).

In order to ensure that the business form components 20 do not move over the stop fingers 38, it is preferred to provide the hold down rollers 43 (FIGS. 2 and 3), and the hold down straps 44 (FIG. 3). The rollers 43 are mounted by arms 45 on the horizontally extending rod 46 (perpendicular to the first direction 13), and may be either spring biased or gravity biased down toward the conveyor tapes 30. Desirably, an adjustable edge guide 48 may also be mounted on the rod 46 for adjustment along the length thereof, including for alignment with the edge surface 15 of the feed means/aligner 12, or to guide the opposite edge of the form components from the guide edge 15 (as seen in FIG. 3).

The position of the stop means 28 along the conveyor 30 may be varied depending upon the length of the business form components 20 to be handled. Desirably, the length from the roller 34 (the start of the second conveyor portion 32) to the top fingers 38 is just slightly less than the length of the business form components 20 being handled. This is so that a small portion of the business form component 20 that has just been fed into engagement with the stop finger 38 sticks out past the roller 34, past the start of the slope of the first conveyor portion 31, so that the next business form component 20 being fed thereto will go under the business form component fed just earlier.

In order to allow adjustment, the motor 40 and shaft 39 associated therewith may be movably mounted along the length of the collector means 14, as being mounted by a guide track 50 (see FIG. 3) and a chain 51 engaging a sprocket (not shown) mounted on the bottom of the motor 40 housing, the controller 26 controlling driving of the chain 51 with an additional motor (not shown) to positively position the stop elements 38 at the desired location. The rod 46 is also attached to the motor 40 housing and maintains a position relative to the stop shaft 39.

Under some circumstances, it is desirable to change the number of form components to be provided in a stack before the stop fingers 38 are moved to a conveyance-allowing position. This could depend upon the details of the form components 20. In order to accommodate this, an optical scanner 56 (see FIGS. 1 and 4) may be provided, connected up to the computer 26. The scanner 56 may be positioned at a particular location along the width of the collector 14 where data having indicia in some way providing an indication of the number of parts of the component for a stack to be formed, will be provided. Once the scanner 56 relays the correct information to the computer 26, the computer counts the number of form component trailing edges sensed by the sensor 19 before it is necessary to activate the solenoid 37 and stepper motor 40.

The apparatus downstream of the collector means 14 are not part of the present invention, but may comprise a wide variety of different components. The diverter 17, which may comprise a solenoid connected to a diverting lever, may be operated if an error message is generated, such as if the data supplied by the scanner 56 and the counts provided by the sensor 19 do not properly correspond or if an illegal stack is detected. The diverting lever—shown schematically and in dotted line at 58 in FIG. 4—may then be directed downwardly to a waste disposal, or reuse, position. If the diverter lever 58 is not activated, however, the business form components may pass directly to a subsequent operation such as the pressure sealer 16, at which the patterns of pressure sensitive adhesive 23, 24 provided on the business form component parts 21, 22 are acted upon by compressive rollers to seal the parts 21, 22 permanently together with the pressure sensitive adhesive to provide a completed business form, or a secondary stacker for building stacks to four inches, etc.

Figure 5:
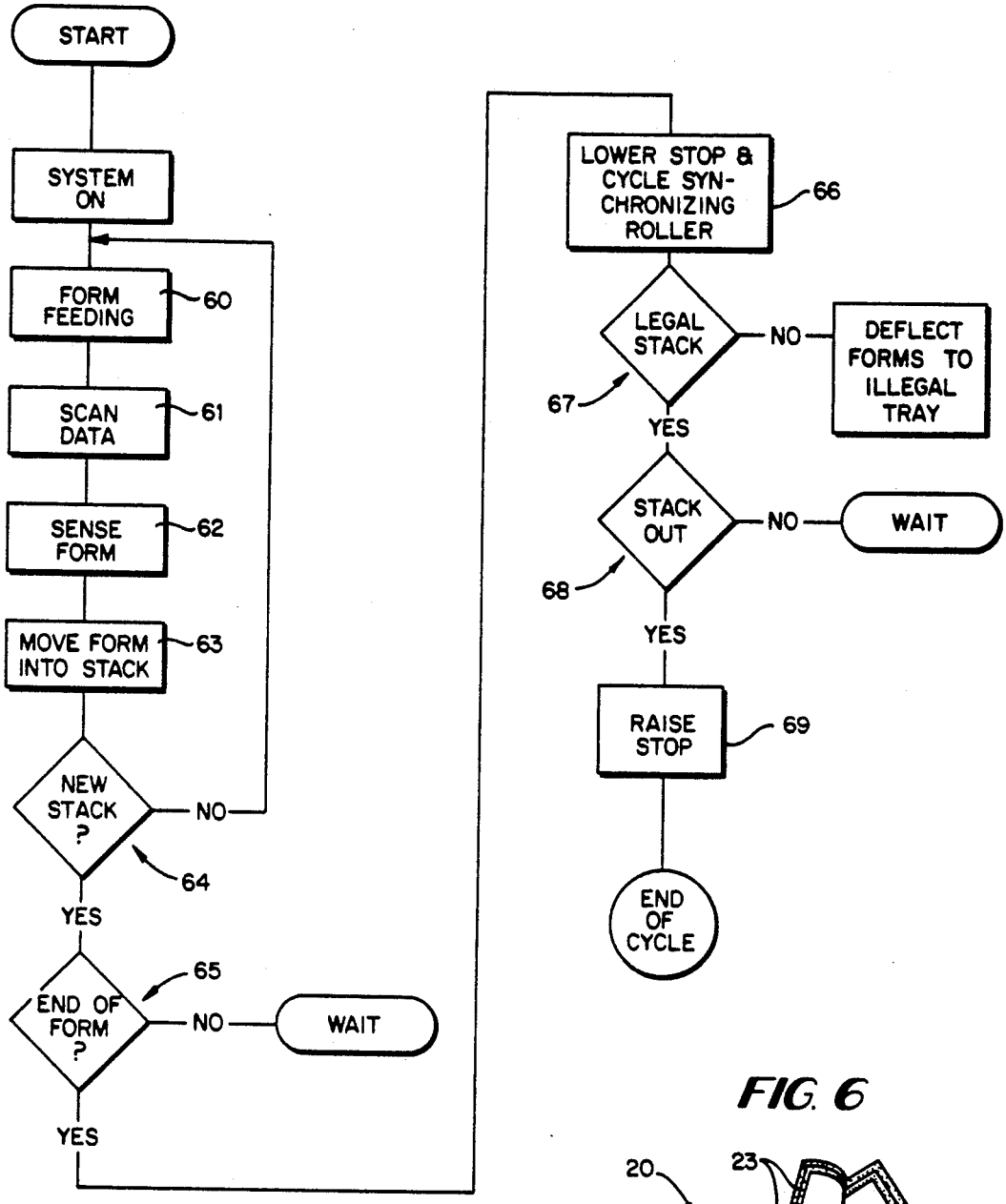
FIG. 5 is a high level control schematic showing an exemplary manner of practicing the method according to the invention.

FIG. 5 is a schematic high level flow chart illustrating exemplary operation of the apparatus 10. Form feeding block 60 indicates that the feed means/aligner 12 is actuated to feed form components in the first direction 13 towards the collector means 14. Scanned data 61 is provided by the scanner 56, while the form sensing 62 is provided by the sensor 19, while the block 63 indicates that the form components 20 are moved into contact with the stop fingers 38, each component being fed under the previous component.

Once a stack of desired size is determined by the computer 26, from the data provided by sensor 19 and scanner 56, to exist, then—as indicated by decision block 64—once the end of the last component 20 is sensed, as indicated at decision block 65, then the stop elements 38 are lowered and the synchronizing roller 34 is cycled, being moved downwardly so as to pinch all of the form components 20 together with the roller 38', to make sure that they are all conveyed together in direction 13. This operation is indicated by box 66 in FIG. 5.

If the optional diverter is utilized, then a decision block 67 is provided to indicate whether or not the lever 58 should be activated to deflect form components away. If the stack is proper, then at decision block 68 it is determined whether or not the stack has passed the end of the collector means 14 (e.g. into the pressure sealer 16 or other equipment), or otherwise cleared stop means 28. A sensor (not shown) may be provided at the end of the conveyor 30 in the direction 13, or above elements 38, for that purpose. Once it has been determined that the stack has passed completely past the stop means 28 and/or past the end of the conveyor 30 in direction 13, then the computer 26 is controlled to rotate the shaft 39 to put the fingers 38 back in their vertical position, as indicated by block 69 in FIG. 5.

It will thus be seen that according to the present invention a simple method and apparatus have been provided for intelligently separating, stacking, and delivering business form components, or the like, in a high speed, versatile, and effective manner. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent apparatus and processes.

What is claimed is:

1. Apparatus for separating business form components into different jobs, comprising:

feed means for automatically feeding business form components in a first direction;

collector means comprising conveying means having a top, conveying, surface continuing running in the first direction, and a movable stop means cooperating with said conveying means top surface, movable between a first position preventing conveyance of business form components past said stop means by said conveying means, and a second position, allowing conveyance of business form components therepast;

sensor means for sensing passage of form components from said feed means to said collector means in the first direction;

control means for controlling the position of said stop means in response to input from said sensor means;

wherein said conveying means of said collector means comprises at least one conveyor belt having a first portion closest to said feed means, and a second portion cooperating with said stop means; and wherein said first portion is slanted significantly upwardly from said feed means to said second portion so that a form component stopped by said stop means and in association with said second portion slightly overlaps said first portion, so that a form component passing on said first portion will pass under the business form component already resting on said second portion;

synchronizing means for selectively engaging business form components when on said conveying means top surface and abutting said stop means to ensure that the components are moved together, synchronously, by said conveying means past said stop means once said stop means are moved to said second position; and wherein said control means comprises means for controlling the position of said stop means and said synchronizing means in response to input from said sensor means so that said synchronizing means are operated to engage said business form components in coincidence with movement of said stop means to said second position.

2. Apparatus as recited in claim 1 wherein said feed means comprises means for aligning business form components so that one side edge thereof, parallel to the first direction, is in a predetermined position when delivered to said collector means.

3. Apparatus as recited in claim 2 further comprising an adjustable edge guide for form components, disposed above said conveying means.

4. Apparatus as recited in claim 1 wherein said at least one conveyor belt comprises a plurality of belts spaced from each other in a second direction substantially transverse to said first direction; and wherein said stop means comprises a plurality of stop elements mounted on a shaft, and extending between said belts in said first position.

5. Apparatus as recited in claim 1 wherein said synchronizing means comprises a first roller mounted above said second portion of said conveying means adjacent the interface between said first and second portions of said conveying means, and means for moving said first roller into contact with the business form components to ensure that they are conveyed together by said conveying means when said stop means is moved to said second position.

6. Apparatus as recited in claim 5 wherein said synchronizing means further comprises a second, stationary, roller mounted below said first roller and having a peripheral portion at approximately the same vertical position as the top surface of said conveying means below said first roller, said second roller cooperating with said first roller when said first roller is moved into engagement with business form components on said conveying means top surface, so that business form components are pinched therebetween.

7. Apparatus as recited in claim 1 further comprising hold down means engaging business form components on said conveying means to preclude them from rising up past said stop means when in said first position, but to be readily conveyed past said stop means by said conveying means when in said second position.

8. Apparatus as recited in claim 1 wherein said conveying means first and second portions are disposed so that said first portion is slanted 10°–40° upwardly with respect to said second portion.

9. Apparatus as recited in claim 1 further comprising means for mounting said stop means for movement in said first direction to adjust the position of said stop means with respect to said conveying means.

10. Apparatus for separating business form components into different jobs, comprising:

feed means for automatically feeding business form components in a first direction;

collector means comprising conveying means having a top, conveying, surface for conveying form components in the first direction, and a movable stop means cooperating with said conveying means top surface, movable between a first position preventing conveyance of business form components past said stop means by said conveying means, and a second position, allowing conveyance of business form components therepast;

sensor means for sensing passage of form components from said feed means to said collector means in the first direction;

synchronizing means for selectively engaging business form components when on said conveying means top surface and abutting said stop means to ensure that the components are moved together, synchronously, by said conveying means past said stop means once said stop means is moved to said second position;

control means for controlling the position of said stop means and said synchronizing means in response to input from said sensor means so that said synchronizing means are operated to engage said business form components in coincidence with movement of said stop means to said second position;

scanner means for scanning form components delivered to said collector means and connected to said control means;

a sealer mechanism downstream of said collector means; and diverter means for selectively diverting form components from said conveying means top surface away from said sealer mechanism, said diverter means controlled by said control means in response to information from said scanner means.

11. Apparatus as recited in claim 10 wherein said synchronizing means comprises a first roller mounted above said conveying means, and means for moving said first roller into contact with said business form components to ensure that they are conveyed together and in register with each other by said conveying means when said stop means is moved to said second position.

12. Apparatus as recited in claim 10 further comprising hold down means engaging business form components on said conveying means to preclude them from rising up past said stop means when in said first position, but to be readily conveyed past said stop means by said conveying means when in said second position.

13. Apparatus as recited in claim 10 wherein said feed means comprises means for aligning business form components so that one side edge thereof, parallel to the first direction, is in a predetermined position when delivered to said collector means.

14. Apparatus as recited in claim 13 further comprising an adjustable edge guide for form components, disposed above said conveying means.

15. Apparatus for separating business form components into different jobs, comprising:

feed means for automatically feeding business form components in a first direction;

collector means comprising conveying means having a top, conveying, surface continuously running in the first direction, and a movable stop means cooperating with said conveying means top surface, movable between a first position preventing conveyance of business form components past said stop means by said conveying means, and a second position, allowing conveyance of business form components therepast;

sensor means for sensing passage of form components from said feed means to said collector means in the first direction;

control means for controlling the position of said stop means in response to input from said sensor means;

wherein said collector means delivers each successive form component from said feed means into engagement with said conveying means top surface regardless of whether or not other form components are already on said conveying means top surface and engaging said stop means;

synchronizing means for selectively engaging business form components when on said conveying means top surface and abutting said stop means to ensure that the components are moved together, synchronously, by said conveying means past said stop means once said stop means are moved to said second position; and wherein said control means comprises means for controlling the position of said stop means and said synchronizing means in response to input from said sensor means so that said synchronizing means are operated to engage said business form components in coincidence with movement of said stop means to said second position.

16. Apparatus as recited in claim 15 wherein said synchronizing means comprises a first roller mounted above said second portion of said conveying means adjacent the interface between said first and second portions of said conveying means, and means for moving said first roller into contact with the business form components to ensure that they are conveyed together by said conveying means when said stop means is moved to said second position.

17. Apparatus for separating business form components into different jobs, comprising:

feed means for automatically feeding business form components in a first direction;

collector means comprising conveying means having a top, conveying, surface for conveying form components in the first direction, and a movable stop means cooperating with said conveying means top surface movable between a first position preventing conveyance of business form components past said stop means by said conveying means, and a second position, allowing conveyance of business form components therepast;

sensor means for sensing passage of form components from said feed means to said collector means in the first direction;

synchronizing means for selectively engaging business form components when on said conveying means top surface and abutting said stop means to ensure that the components are moved together, synchronously, by said conveying means past said stop means once said stop means is moved to said second position;

control means for controlling the position of said stop means and said synchronizing means in response to input from said sensor mean so that said synchronizing means are operated to engage said business form components in coincidence with movement of said stop means to said second position; and wherein said synchronizing means comprises a first roller mounted above said conveying means, and a solenoid controlled by said control means for moving said first roller into contact with the business form components to ensure that they are conveyed together and in register with each other by said conveying means when said stop means is moved to said second position.

18. Apparatus as recited in claim 17 wherein said synchronizing means further comprises a second, stationary, roller mounted below said first roller and having a peripheral portion at approximately the same vertical position as the top surface of said conveying means below said first roller, said second roller cooperating with said first roller when said first roller is moved into engagement with business form components on said conveying means top surface, so that business form components are pinched therebetween.

* * * * *